US008311441B2

(12) United States Patent
Inoue

(10) Patent No.: US 8,311,441 B2
(45) Date of Patent: Nov. 13, 2012

(54) CHARGING APPARATUS HAVING CLEANING DEVICE

(75) Inventor: Ryo Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 292 days.

(21) Appl. No.: 12/561,174

(22) Filed: Sep. 16, 2009

(65) Prior Publication Data

US 2010/0067939 A1 Mar. 18, 2010

(30) Foreign Application Priority Data

Sep. 16, 2008 (JP) ..... 2008-236314

(51) Int. Cl.
*G03G 15/02* (2006.01)

(52) U.S. Cl. ..... 399/100; 399/171

(58) Field of Classification Search ..... 399/100, 399/170, 171

See application file for complete search history.

(56) References Cited

U.S. PATENT DOCUMENTS

| | | | | |
|---|---|---|---|---|
| 5,485,251 | A * | 1/1996 | Kita et al. | 399/343 |
| 5,532,798 | A * | 7/1996 | Nakagami et al. | 399/170 |
| 2006/0002740 | A1 | 1/2006 | Tanaka et al. | |

FOREIGN PATENT DOCUMENTS

| | | | |
|---|---|---|---|
| JP | 57185053 | A * | 11/1982 |
| JP | 60057363 | A * | 4/1985 |
| JP | 06-43735 | | 2/1994 |
| JP | 06-208283 | | 7/1994 |
| JP | 2005-338797 | | 12/2005 |

* cited by examiner

*Primary Examiner* — Walter L Lindsay, Jr.
*Assistant Examiner* — Billy J Lactaoen
(74) *Attorney, Agent, or Firm* — Canon USA Inc IP Division

(57) ABSTRACT

A charging apparatus includes a corona charger which includes a discharging wire and a grid electrode that are configured to charge a member to be charged, a cleaning device configured to clean an inner surface of the grid electrode, and a discharging device configured to electrically discharge the grid electrode before the cleaning device cleans the grid electrode.

3 Claims, 10 Drawing Sheets

CHARGING APPARATUS HAVING CLEANING DEVICE

BACKGROUND OF THE INVENTION

1. Field of the Invention

The present invention relates to a charging apparatus which charges a member to be charged using a corona charger. The charging apparatus is used for an electrophotographic image forming apparatus such as a copy machine, a printer, a facsimile, and a multifunction peripheral which includes a plurality of functions of copying, printing, and sending a facsimile.

2. Description of the Related Art

In a charging process, which is one of electrophotographic processes, a conventional electrophotographic image forming apparatus evenly charges a photosensitive member to be charged using a corona charger.

A configuration for charging with the corona charger can cause foreign substances (adhering substances) such as dusts and scattered toner suspended within the apparatus to adhere to a grid electrode.

If the foreign substances are adhering to the grid electrode, a charging efficiency decreases at a portion to which the foreign substances is adhering and uneven charge potential appears on the photosensitive member. Thus an output image may show non-uniform density.

Apparatuses discussed in Japanese Patent Applications Laid-Open Nos. 06-43735, 06-208283, and 2005-338797 are provided with a cleaning apparatus for cleaning a grid electrode by using a cleaning pad or a cleaning brush and cleaning the foreign substances adhering to an inner surface of the grid electrode of the corona charger.

However, the apparatuses discussed in Japanese Patent Applications Laid-Open Nos. 06-43735, 06-208283, and 2005-338797 cannot appropriately remove the foreign substances adhering to the inner surface of the grid electrode.

This is because if insulating foreign substances such as toner adheres to the grid electrode and receive corona discharge, an amount of charge thereof is increased, so that electrostatic force of the foreign substances adhering to the grid electrode is increased.

The longer the foreign substances receives the corona discharge, the larger the electrostatic adhesion (referred to as "a reflection force") of the foreign substances becomes. The electrostatic adhesion can be expressed by the electrostatic force together with a mirror image charge generated on the grid electrode, and is proportional to the square of the amount of the charge of the foreign substances.

In order to remove from the grid electrode the foreign substances rigidly adhering thereto, a method is considered for increasing a cleaning ability of the cleaning apparatus, for example, by strongly pressing the cleaning brush against the grid electrode.

However, such method may cause an adverse effect since the foreign substances may be rubbed against the grid electrode. As a result, the foreign substances are fusion-bonded to the grid electrode and cause the uneven charge potential on the photosensitive member and non-uniform density in an output image.

SUMMARY OF THE INVENTION

The present invention is directed to charging apparatuses which can appropriately remove substances which adhere to an inner surface of a grid electrode of a corona charger.

According to an aspect of the present invention, a charging apparatus includes a corona charger which includes a discharging wire and a grid electrode that are configured to charge a member to be charged, a cleaning device configured to clean an inner surface of the grid electrode, and a discharging device configured to electrically discharge the grid electrode before the cleaning device cleans the grid electrode.

Further features and aspects of the present invention will become apparent from the following detailed description of exemplary embodiments with reference to the attached drawings, in which like reference characters designate the same or similar parts throughout the figures thereof.

BRIEF DESCRIPTION OF THE DRAWINGS

The accompanying drawings, which are incorporated in and constitute a part of the specification, illustrate exemplary embodiments of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
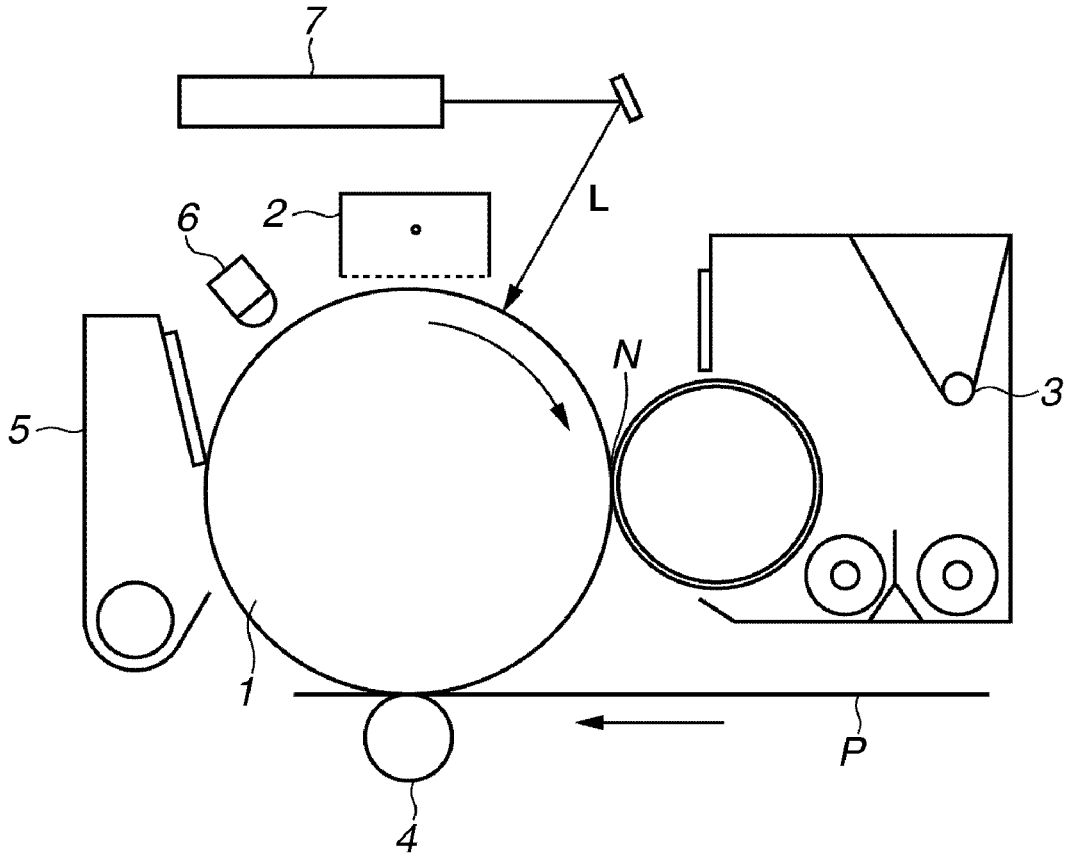
FIG. 1 is a schematic cross sectional view illustrating an image forming apparatus.

FIG. 1 is a schematic side view of an electrophotographic image forming apparatus. An overall configuration of an image forming unit in the image forming apparatus will be described first, and then a charging apparatus will be described in detail.

As illustrated in FIG. 1, an electrophotographic photosensitive member (hereafter, referred to as a "photosensitive member") 1 which is a member to be charged is disposed rotatably in a direction shown by an arrow.

In a periphery of the photosensitive member 1, a charging apparatus (also referred to as a corona charger) 2, an image-exposure apparatus 7, a developing apparatus 3, a transfer apparatus 4, a cleaning apparatus 5, and a light-neutralization apparatus 6 are disposed in order along the rotating direction of the photosensitive member 1.

The image forming unit as described above can form a toner image on a sheet P which is recording paper by an electrophotographic process.

More specifically, the charging apparatus 2 negatively and evenly charges a surface of the photosensitive member 1. Laser light L corresponding to an image signal is emitted from the image-exposure apparatus 7 to the surface of the photosensitive member 1. As a result, electric potential at a portion of the photosensitive member 1 which is irradiated with the light, attenuates to form an electrostatic latent image corresponding to the image signal.

Subsequently, negatively charged toner is applied to the electrostatic latent image formed on the photosensitive member 1 by the developing apparatus 3 to form a toner image according to the electrostatic latent image. The toner image formed on the photosensitive member 1 is electro-statically transferred to the sheet P by the transfer apparatus 4. The toner image transferred onto the sheet P is fixed by a fixing device (not illustrated) and discharged to an outside of the apparatus.

The cleaning apparatus 5 scrapes transfer residual toner remaining on the photosensitive member 1 and collects the toner therein. The light-neutralization apparatus 6 eliminates electric potential remaining on the photosensitive member 1 to form a next image thereon.

Figure 2:
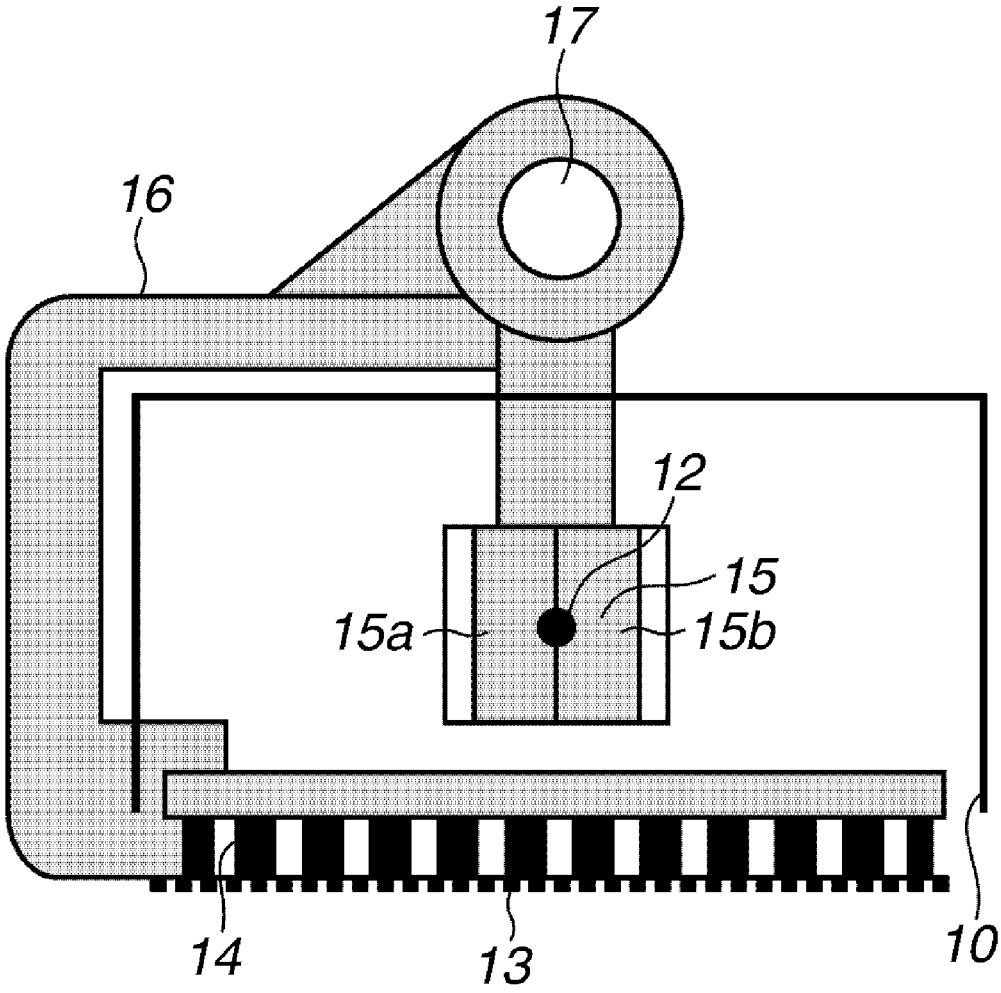
FIG. 2 is a schematic cross sectional view from a front of a corona charger.
Figure 3:
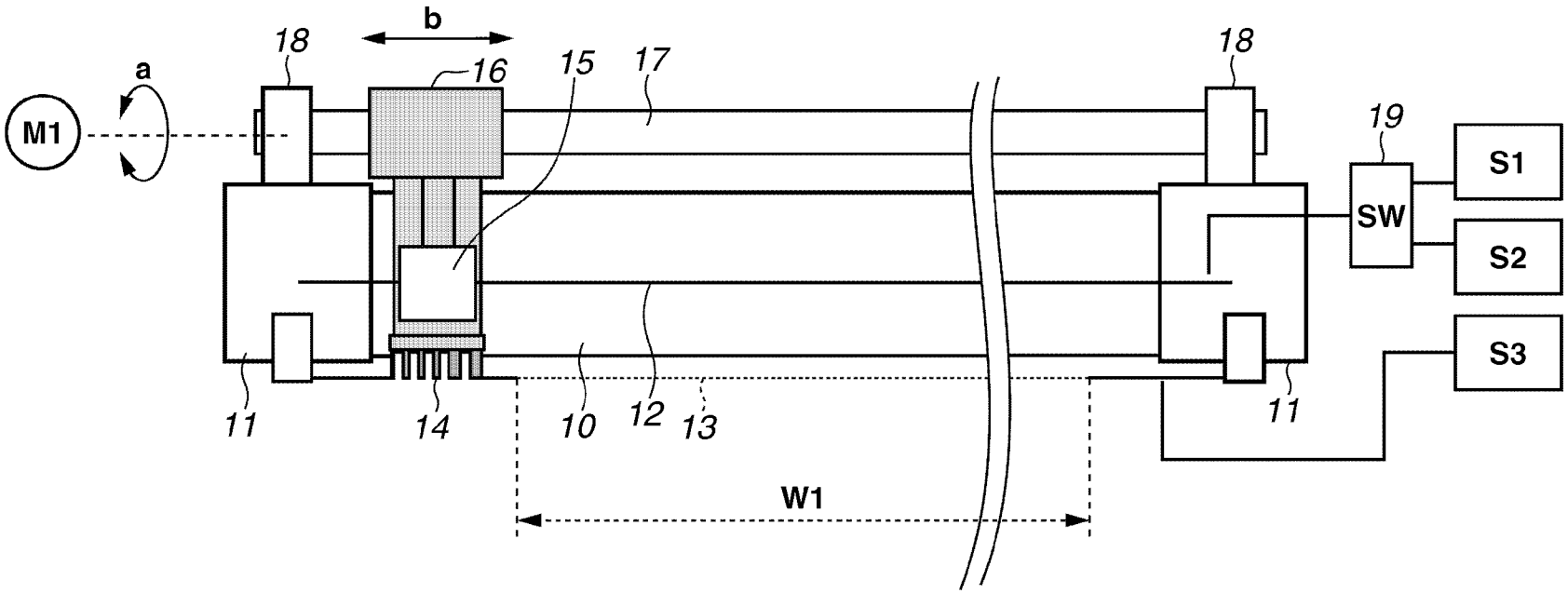
FIG. 3 is a schematic cross sectional view from a side of the corona charger.

With reference to FIGS. 2 and 3, the charging apparatus will be described. FIG. 2 is a cross sectional view in a lengthwise direction (from a front) of the charging apparatus 2, and FIG. 3 is a cross sectional view in a widthwise direction (from a side) thereof.

The present exemplary embodiment, as illustrated in FIGS. 2 and 3, employs the corona charger as the charging apparatus 2. The corona charger 2 includes a U-shaped shield case 10 (hereafter referred to as a "shield") that is provided with a insulating supporting unit 11 at each end and a discharging wire 12 (also referred to as a "wire electrode") which is a discharging electrode stretched inside the shield 10 along the lengthwise direction thereof. Further, a grid electrode 13 is disposed at an opening of the shield 10 facing the photosensitive member 1.

As the discharging wire 12, the present exemplary embodiment employs a tungsten wire having a diameter $\phi$ 60 μm which is stretched via a raised portion and a spring (not illustrated) that are disposed at each of the insulating supporting units 11.

Further, the discharging wire 12 is connected to a power supply S1 (direct current (DC) power supply) to be applied a direct current voltage when the photosensitive member is charged. At this time, the DC voltage to be applied to the discharging wire 12 is controlled to be the −800 μA (constant current control).

As described below, when the grid electrode 13 is cleaned, a switch 19 as a switching unit illustrated in FIGS. 3 and 4 switches the power supply connected to the discharging wire 12 from S1 to S2. At this time, an alternating current voltage (AC voltage) that has ±6 kV, 600 Hz and a rectangular waveform is applied to the discharging wire 12 from a power supply S2 (AC power supply) functioning as a neutralization unit.

For the grid electrode 13, the present exemplary embodiment employs a SUS 304 plate 0.1 mm thick on which large numbers of opening portions are formed by etching. A shortest distance between the grid electrode 13 and the photosensitive member 1 is 1.0 mm. Further, for rust proof treatment, nickel-plating 1 μm thick is performed on a surface of the grid electrode 13.

According to the above-described configuration, a charging range by the charging apparatus 2 is defined as a range W1 corresponding to a range where the grid electrode 13 is set. In other words, the opening portion of the shield is provided at the region corresponding to the range W1.

Further, a power supply S3 (DC power supply) is connected to the grid electrode 13 to apply the DC voltage of −400 V to −900 V when the photosensitive member is charged. The power supply S3 can stabilize an amount of ions which transfer from the discharging wire 12 to the photosensitive member, so that the photosensitive member can be charged to the desired electric potential (−600 V in the present exemplary embodiment).

As described below, in FIG. 4, when the grid electrode 13 is cleaned, the power supply S3 stops applying the charging voltage and is switched to electrically ground (0V). More specifically, according to the present exemplary embodiment, the power supply S3 also functions as an earth mechanism and can be grounded by turning off the voltage supply. The earth mechanism is not limited to an example of the present exemplary embodiment but another known earth mechanism may be employed.

The charging apparatus 2 according to the present exemplary embodiment includes cleaning apparatuses for cleaning the discharging wire 12 and the grid electrode 13 respectively.

The cleaning apparatus for cleaning the discharging wire 12 includes a discharging wire cleaning device 15 as illustrated in FIGS. 2 and 3. As illustrated in FIG. 2, the discharging wire cleaning device 15 includes a pair of sponge pads 15*a* and 15*b* which are disposed to press and contact the discharging wire 12 from both sides. Polishing paper may be attached on sliding surfaces between the discharging wire 12 and each of the sponge pads.

The discharging wire cleaning device 15 can reciprocate in a direction shown by an arrow "b" (substantially parallel to a direction the discharging wire 12 is stretched) in FIG. 3 by a moving mechanism.

More specifically, the discharging wire cleaning device 15 is held by a holder 16 which is engaged with a screw shaft 17 disposed at a side opposite to where the corona charger 2 faces the photosensitive member 1.

The screw shaft 17 has a spiral groove on a circumferential surface thereof in the lengthwise direction. Further, the screw shaft 17 is held by each bearing 18 on each of the insulating supporting units 11 and rotated and driven in a direction shown by an arrow "a" by a motor M1 connected to drive the screw shaft 17.

As a result, along with rotation of the screw shaft 17, the holder 16 can reciprocate in the direction shown by the arrow "b". More specifically, when the screw shaft 17 is rotated in a forward direction, the holder 16 moves forward. When the screw shaft 17 is rotated in a backward direction, the holder 16 moves backward.

Figure 4:
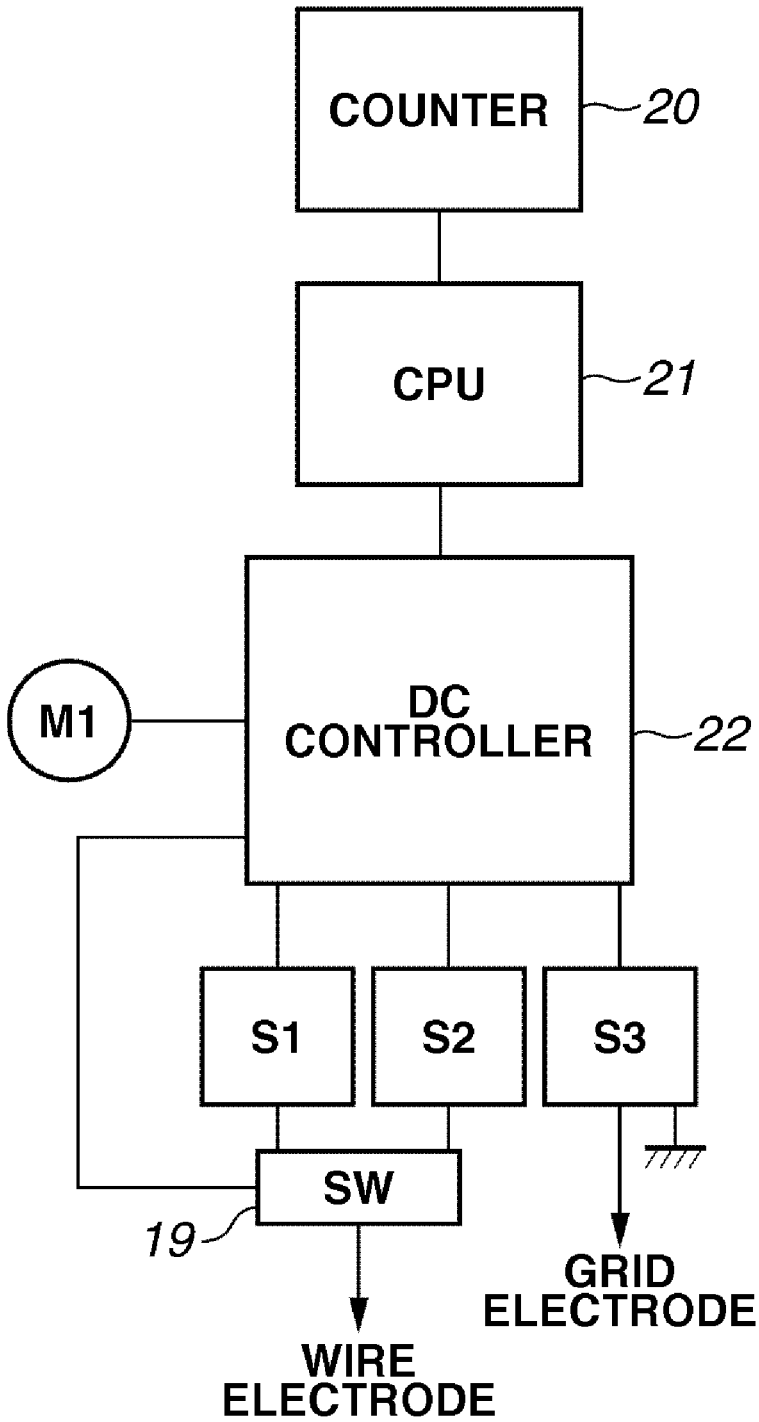
FIG. 4 is a block diagram illustrating a control system for controlling the corona charger.

A DC controller 22 illustrated in FIG. 4 controls the motor M1 to reciprocate the holder 16 as described above and to set a moving speed of the discharging wire cleaning device 15 at 35 mm/sec.

FIGS. 2 and 3 illustrate states in which the discharging wire cleaning device 15 stays at an inoperative position outside a charging range W1. When the photosensitive member is charged to form a normal image, the discharging wire cleaning device 15 stays at the inoperative position which is a home position of the discharging wire cleaning device 15.

More specifically, as described above, when the discharging wire cleaning device 15 performs cleaning, the discharging wire cleaning device 15 is moved from the home position to an reversal position on the right of the charging range W1 (in FIG. 3).

When the discharging wire cleaning device 15 reaches the reversal position, the DC controller 22 reverses a rotating direction of the screw shaft 17 and moves the discharging wire cleaning device 15 back to the home position by reversing the moving direction thereof.

A central processing unit (CPU) 21 controls timing for reversing the rotating direction of the motor M1 and for stopping the motor M1 based on operation time for driving (turning on) the motor M1. Position detection sensors may be provided at portions corresponding to the reversal position and the inoperative position (home position). Further, a detection flag to be detected by the position detection sensor may be set at the holder 16 to control the motor M1.

More specifically, based on an output of the position detection sensor, the CPU 21 may control the timing for reversing the rotating direction of the motor M1 and for stopping the motor M1.

By performing a series of reciprocating movements, the discharging wire cleaning device 15 completes the cleaning.

The cleaning apparatus for cleaning and removing the foreign substances (adhering substances) that adhere to an inner surface of the grid electrode 13 includes a grid electrode cleaning device (cleaning device) 14 as illustrated in FIGS. 2 and 3. As illustrated in FIG. 2, the grid electrode cleaning device 14 includes a brush that can slide on the grid electrode 13 and has flexible fibers planted on a base cloth.

The brush is attached to the holder 16 such that end portions of the fibers are in contact with the inner surface of the grid electrode 13 (surface at the side of the discharging wire 12). Further, from a point of view for preventing leakage from the grid electrode 13, it is desirable to use an insulating material for the brush. The present exemplary embodiment employs nylon as a material of the brush.

Since the grid electrode cleaning device 14 is attached to the holder 16 similarly to the discharging wire cleaning device 15, the grid electrode cleaning device 14 can be reciprocated together with the discharging wire cleaning device 15 in the direction shown by the arrow "b" illustrated in FIG. 3 by the moving mechanism.

More specifically, along with the screw shaft 17 rotated by the motor M1, the holder 16 is reciprocated along the lengthwise direction of the corona charger 2 and cause the grid electrode cleaning device 14 and the discharging wire cleaning device 15 to reciprocate.

Therefore, as described above, when the grid electrode cleaning device 14 cleans the grid electrode 13, the grid electrode cleaning device 14 moves together with the discharging wire cleaning device 15 from the home position to the reversal position on the right side of the charging range W1.

When the grid electrode cleaning device 14 and the discharging wire cleaning device 15 reach the reversal position, the DC controller 22 reverses the rotating direction of the screw shaft 17 and the moving directions of the grid electrode cleaning device 14 and the discharging wire cleaning device 15. As a result, the grid electrode cleaning device 14 and the discharging wire cleaning device 15 move back to the home position and then the grid electrode cleaning device 14 completes the cleaning processing.

As described above, the grid electrode cleaning device 14 and the discharging wire cleaning device 15 simultaneously perform the cleaning.

FIG. 4 is a block diagram of a control circuit that controls the cleaning apparatus for cleaning the discharging wire 12 and the grid electrode 13 in the charging apparatus 2.

A counter 20 counts a number of image outputs output by the image forming unit. The CPU 21 as the control unit controls the DC controller 22 to perform cleaning when the number of image outputs reaches a predetermined number (5,000 outputs according to the present exemplary embodiment). More specifically, the DC controller 22 controls operations of the switch 19, the motor M1, the power supply S1, the power supply S2, and the power supply S3 to perform cleaning.

According to the present exemplary embodiment, before cleaning of the grid electrode 13, the neutralization unit neutralizes the foreign substances adhering to the inner surface of the grid electrode 13. According to the present exemplary embodiment, the power supply S2, the power supply S3 that grounds the grid electrode 13, the discharging wire 12, and the switch 19 function as the neutralization unit.

Figure 5:
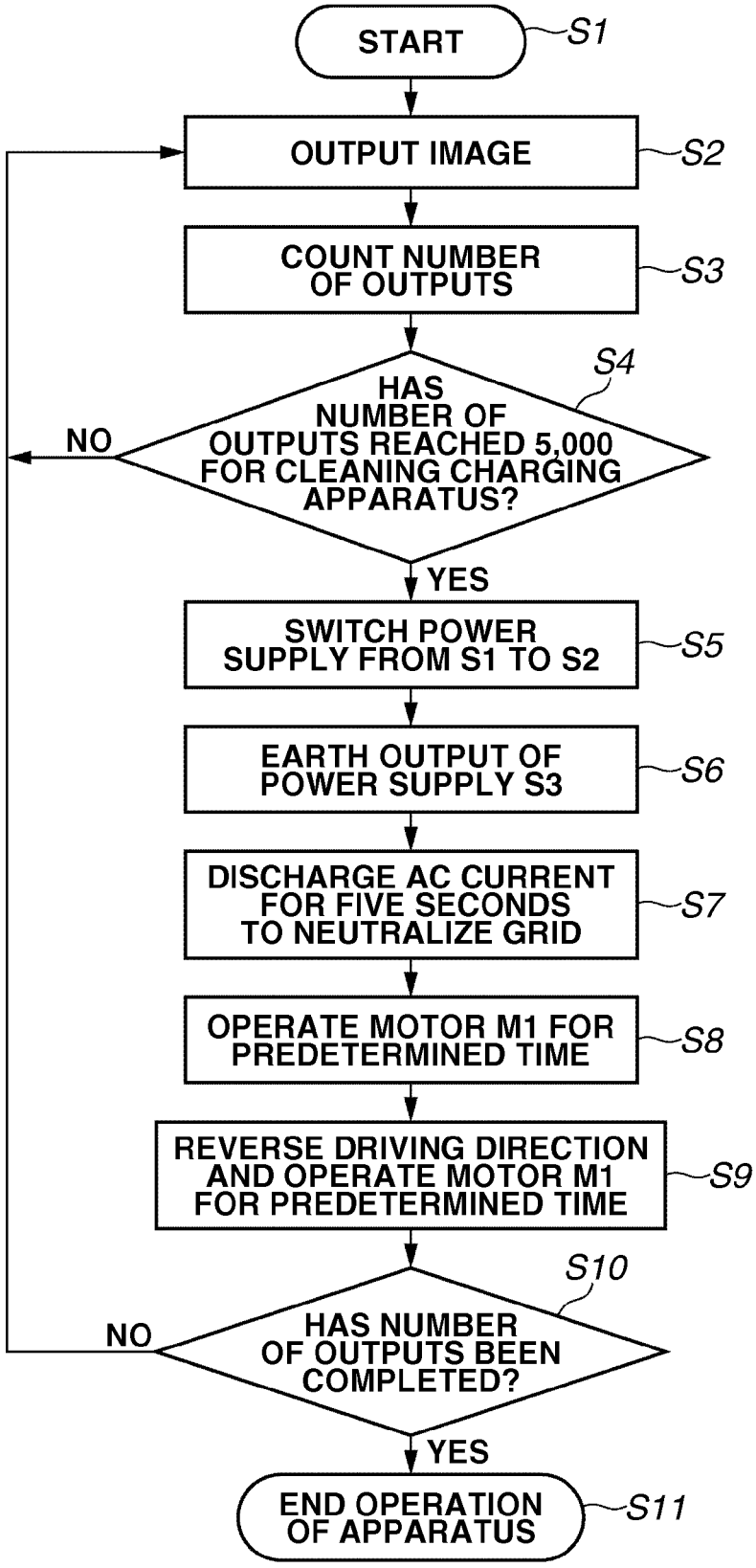
FIG. 5 is a flowchart illustrating a flow of cleaning of the corona charger.

Next, a cleaning sequence for the charging apparatus will be described with reference to a flowchart illustrated in FIG. 5. The CPU 21 entirely controls steps of the cleaning sequence.

Upon starting an image formation in step S1, an image output is started in step S2, and the counter 20 counts the number of the image outputs in step S3. In step S4, when the CPU 21 determines that the number of the image outputs has not reached the predetermined number (5,000) (NO in step S4), steps S1, S2, and S3 are repeated.

When the CPU 21 determines that the number of the image outputs reaches the predetermined number (5,000) (YES in step S4), processing proceeds to step S5.

In step S5, the CPU 21 instructs the DC controller 22 to send a signal for operating the switch 19. More specifically, the power supply for applying the voltage to the discharging wire 12 is switched from the power supply S1 to the power supply S2 by the signal from the DC controller 22. Therefore, the voltage to be applied to the discharging wire 12 is switched from the charging voltage by the power supply S1 to the neutralizing voltage by the power supply S2.

At this time, in step S6, the signal from the DC controller 22 turns off the power supply S3 to stop applying the charging voltage, and then the grid electrode 13 is grounded.

In step S7, the power supply S2 applies the AC voltage to the discharging wire 12 for five seconds to neutralize the foreign substances such as the toner adhering to the inner surface of the grid electrode 13. According to the present exemplary embodiment, time for applying the neutralizing voltage to the discharging wire 12 from the power supply S2 is referred to as neutralization time.

In the present exemplary embodiment, the grid electrode (or the foreign substances) is almost completely neutralized. However, a small amount of charge may remain on the grid electrode (or the foreign substances) when the grid electrode is cleaned (after neutralized), as long as the amount of the charge is at a level which contributes to an effect of cleaning.

As described above, before cleaning of the grid electrode 13, the present exemplary embodiment can remove an effect caused by the electrostatic adhesion of the foreign substances on the grid electrode. Therefore, the foreign substances can be appropriately removed when the cleaning is subsequently performed.

In step S8, the motor M1 for driving the cleaning apparatus is operated to move the discharging wire cleaning device 15 and the grid electrode cleaning device 14 from the home position to the reversal position. At this time, the discharging wire cleaning device 15 and the grid electrode cleaning device 14 clean the discharging wire 12 and the grid electrode 13 respectively.

In step S9, when the discharging wire cleaning device 15 and the grid electrode cleaning device 14 reach the reversal position, the rotating direction of the motor M1 is reversed to reverse the moving direction of the discharging wire cleaning device 15 and the grid electrode cleaning device 14. When the discharging wire cleaning device 15 and the grid electrode cleaning device 14 reach the home position, the motor M1 is stopped to end the series of the cleaning processing. At this time, the discharging wire cleaning device 15 and the grid electrode cleaning device 14 also clean the discharging wire 12 and the grid electrode 13 respectively.

When the cleaning ends, in step S10, the CPU 21 determines if an image forming job has not finished due to interruption by the cleaning. If the image forming job has not finished (NO in step S10), processing returns to step S2 and the suspended image output is resumed. At this time, the signal from the DC controller 22 causes the switch 19 to switch the power supply for applying the voltage to the discharging wire 12 from the power supply S2 to the power supply S1. Further, the power supply S3 for the grid electrode 13 is turned on.

When the remaining image formation of the image formation job is completed, the operation of the image forming unit ends (the power supplies S1 and S3 are turned off).

On the other hand, if the image forming job has finished when the cleaning processing is performed (YES in step S10), then in step S11, the operation of the image forming unit also ends.

While the grid electrode cleaning device 14 is reciprocated for cleaning, neutralization processing may be continued as described above. It is desirable that the grid electrode 13 is neutralized at least before the grid electrode cleaning device 14 starts cleaning.

In order to check a cleaning effect of neutralizing the grid electrode 13 before cleaning, a durability experiment has been conducted.

In the durability experiment, the image forming unit sequentially output the images on 100,000 sheets P, and contamination of the grid electrode and generation of a defective image were checked. The charging apparatus was cleaned every time 5,000 images are output as described above.

According to the present exemplary embodiment, even after 100,000 images are output, the contamination of the grid electrode was so slight that the defective image caused by the contamination of the grid electrode was not generated.

On the other hand, as a comparison example, a similar verification experiment has been conducted under a condition in which the grid electrode was not neutralized in the cleaning processing.

In the comparison example, when the 20,000 images were output, non-uniform density has been generated in a stripe shape in images. The contamination of the grid electrode when the non-uniform image density was generated was checked, and plenty of foreign substances such as toners and dust were observed which adhere to the grid electrode at a position corresponding to where the non-uniform image density of the stripe shape was generated. Such foreign substances includes toners scattered from the developing apparatus 3 and the cleaning apparatus 5 and dust coming from an outside of the image forming apparatus.

Further, in the comparison example, there were some portions where the toner rigidly adhered to the grid electrode. This is probably because the grid electrode has been repeatedly cleaned (scrubbed by the brush) while the toner has hardly moved. Once the toner is rigidly fixed as described above, it is almost impossible to remove the toner by the cleaning apparatus.

Next, the effect of neutralizing the grid electrode before the grid electrode is cleaned will be described. A verification experiment for estimating a cleaning ability by the grid electrode cleaning device 14 has been conducted.

According to the verification experiment, the toner was evenly applied on the inner surface of the grid electrode 13 (an opposite surface to a surface facing the photosensitive member 1). The grid electrode 13 was set in the corona charger 2 and cleaned by the grid electrode cleaning device 14. A changing rate of a ratio of a toner covering area on the grid electrode 13 was acquired and defined as a scale of the cleaning ability.

More specifically, a "ratio of the toner covering area after cleaning" is divided by a "ratio of the toner covering area before cleaning" and multiplied by 100. Hereafter, the rate is referred to as a cleaning efficiency Y (%). In this scale, the larger the changing rate Y, the higher the cleaning ability. In order to increase reproducibility of this value, the ratio of the toner covering area before cleaning was adjusted to 60(%).

Figure 6:
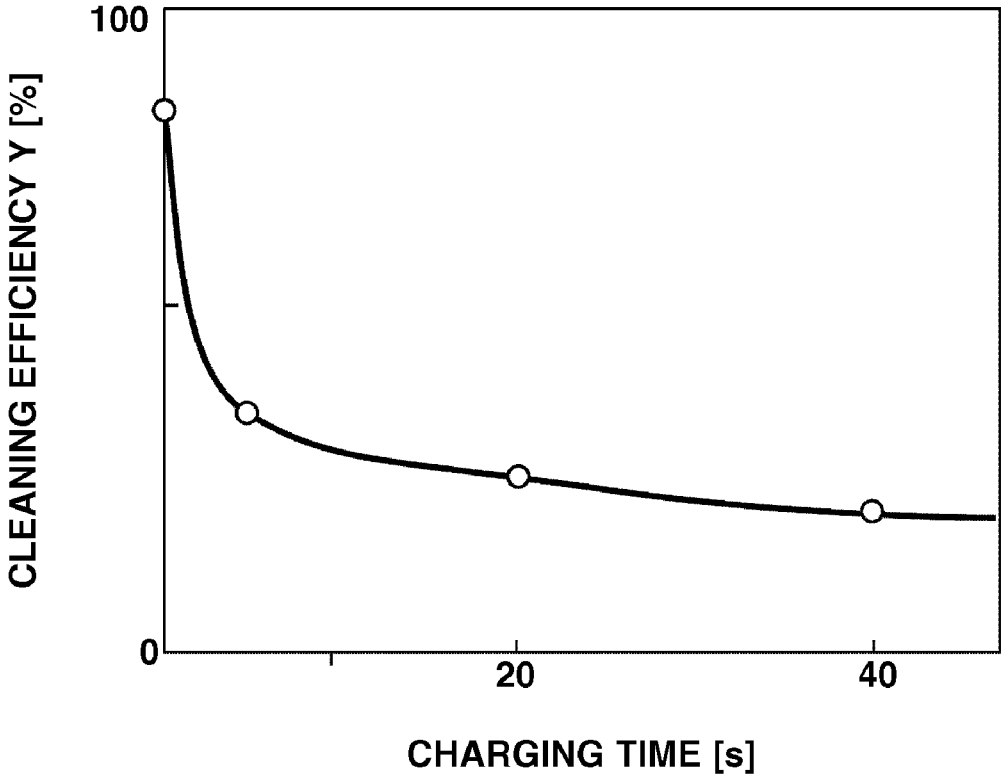
FIG. 6 is a graph illustrating a relationship between charging time and cleaning efficiency.

Before describing results of this verification experiment, another verification of how the cleaning effect shifts when the foreign substances adhering to the grid electrode was charged under a condition of normal image formation will be described. FIG. 6 illustrates a relationship between charging time (discharging time) and the cleaning efficiency Y (%).

After the toner was applied to the grid electrode 13 under the above-described condition, the cleaning efficiency Y was measured under each condition of the charging time of zero seconds, five seconds, twenty seconds, and forty seconds. At this time, the charging voltage was applied to the discharging wire such that the charging current becomes −800 μA that is the same as that for forming the normal image, and the voltage of −700 V was applied to the grid electrode. After charging, the grid electrode was immediately cleaned without being neutralized, and the cleaning efficiency Y (%) was measured.

As illustrated in FIG. 6, the longer the charging time, the more abruptly the cleaning efficiency Y dropped. This is probably because the toner which is the insulating material was charged by receiving corona discharge (the amount of charge was increased), and electrostatic adhesion (referred to as "reflection") to the grid electrode was increased.

Figure 7:
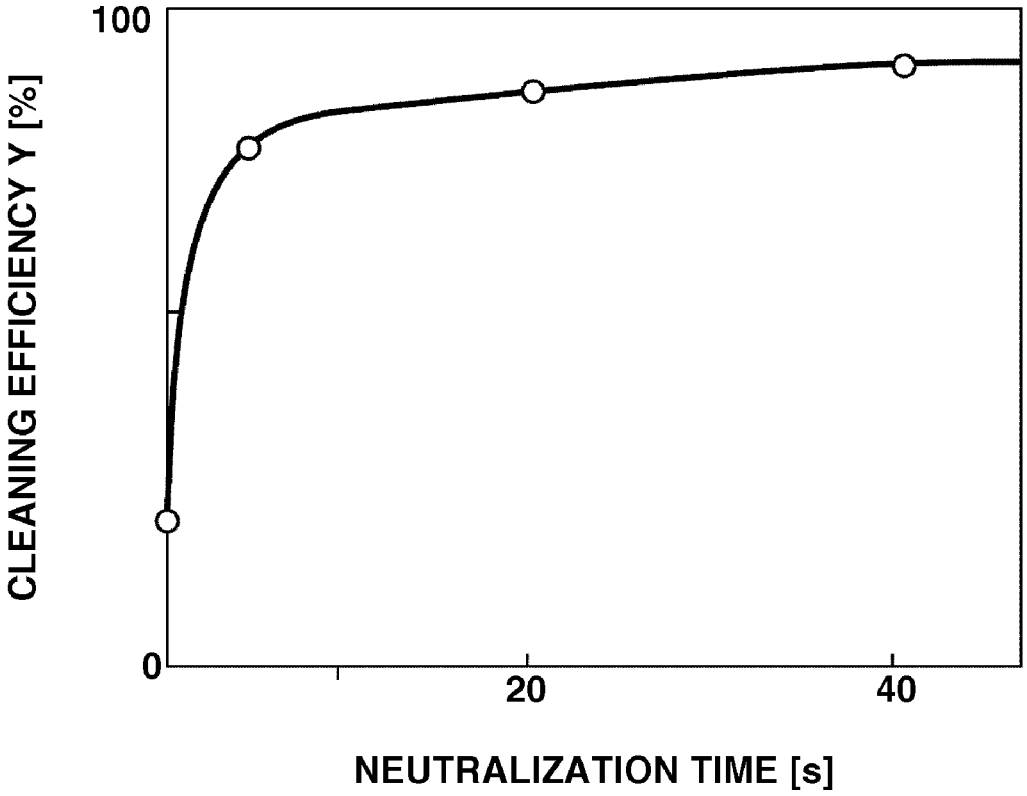
FIG. 7 is a graph illustrating a relationship between neutralization time and cleaning efficiency.

Next, a relationship between the cleaning efficiency and performing time of neutralization (neutralization time) performed before cleaning of the grid electrode will be described. FIG. 7 illustrates a result of the verification.

After the toner was applied to the grid electrode under the above-described condition, the same voltage as that for forming the normal image was applied to the discharging wire and the grid electrode for sixty seconds. More specifically, the charging voltage was applied to the discharging wire such that the charging current becomes −800 μA, and the voltage of −700 V was applied to the grid electrode. Subsequently, the grid electrode was neutralized and then cleaned, and the cleaning efficiency Y (%) was measured.

As a condition of neutralization at this time, the AC voltage having a rectangular waveform of ±6 kV, and 800 Hz was used as the neutralizing voltage to be applied to the discharging wire, and the neutralization time was set to zero seconds, five seconds, twenty seconds, and forty seconds.

As illustrated in FIG. 7, the cleaning efficiency Y (%) was greatly increased when the neutralization time was set to five seconds. When the neutralization time was further increased, the cleaning efficiency was increased but an improving rate became lower.

Therefore, the present exemplary embodiment sets the neutralization time before cleaning of the grid electrode to five seconds. That is because increasing the neutralization time means increasing the cleaning time, and thus time when the image cannot be output increases. More specifically, increasing the neutralization time may decrease image productivity of the image forming apparatus. Thus, it is desirable to set the neutralization time shortest within a range in which the neutralization is effective.

According to the present exemplary embodiment, an outer surface of the grid electrode (a surface facing the photosensitive member) is not cleaned but it may cause no problem. This is because the contamination that is caused by the corona charger and generates uneven charge potential on the photosensitive member is more serious on the inner surface than that on the outer surface. Distribution of the electric potential in the corona charger is not affected by the foreign substances adhering to the outer surface of the grid electrode.

On the other hand, the grid electrode has a configuration in which the inner surface has a shape like a saucer, so that the foreign substances are easily accumulated therein. Further, since the substances (foreign substances such as toners and paper powder) adhering to the inner surface of the grid electrode may disturb the distribution of the electric potential in the corona charger, distribution of the discharging current tends to be uneven and to easily generate the uneven electric potential of the charge on the photosensitive member.

From the reasons described above, according to the present exemplary embodiment, the configuration for cleaning the inner surface of the grid electrode is effective for preventing occurrence of the uneven electric potential of the charge on the photosensitive member. If necessary, it is possible to further provide a cleaning apparatus for cleaning the outer surface of the grid electrode.

An example where the brush is used as the grid electrode cleaning device is described above. However, the grid electrode cleaning device is not limited to the above-described example, and elastic members such as sponge and rubber can be appropriately used.

As described above, the grid electrode cleaning device is in contact with the grid electrode when the grid electrode cleaning device is disposed at the home position. However, the configuration is not limited to the above-described example, and the following configuration may be employed.

For example, a separating mechanism may be provided which separate the grid electrode cleaning device and the grid electrode when the grid electrode cleaning device is disposed at the home position.

More specifically, the screw shaft 17 may be formed to gradually take more distance from the photosensitive member as it moves from the charging range W1 towards the home position, so that the grid electrode cleaning device can be separated from the grid electrode at the home position.

Such a configuration may be employed to prevent the fibers of the brush from bending.

As described above, according to the present exemplary embodiment, since the grid electrode in the corona charger can be appropriately cleaned, the charge can be prevented from being uneven. Thus, occurrence of the non-uniform image density can be prevented.

Figure 8:
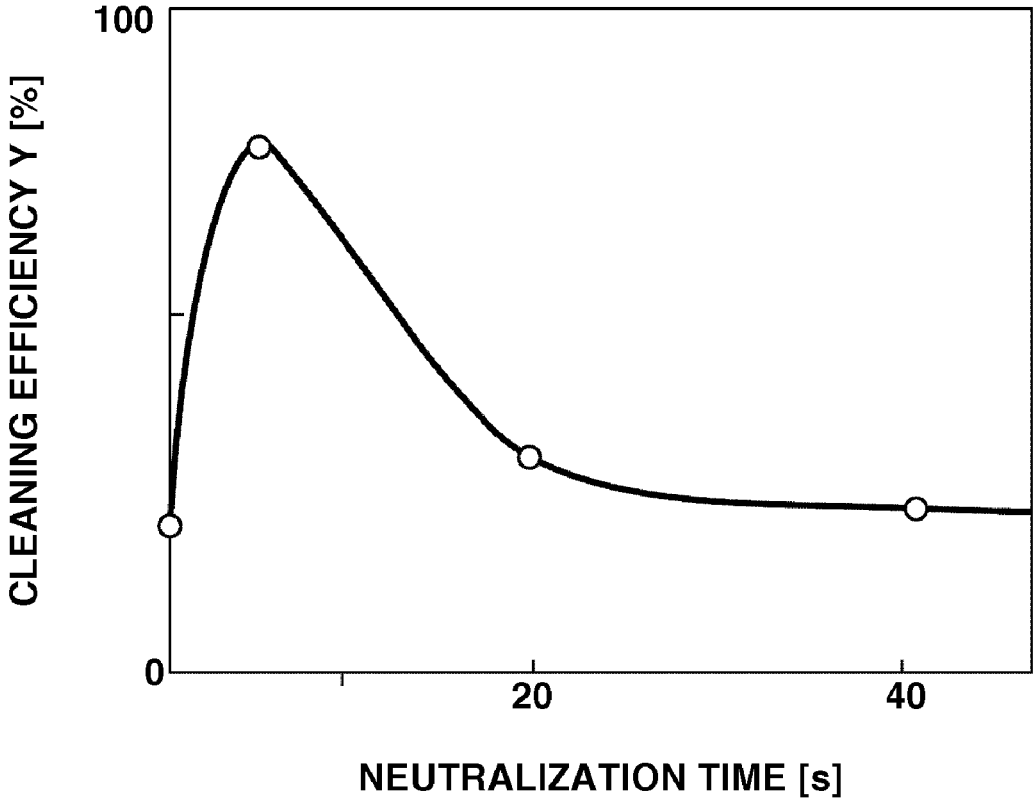
FIG. 8 is a graph illustrating a relationship between neutralization time and cleaning efficiency.
Figure 9:
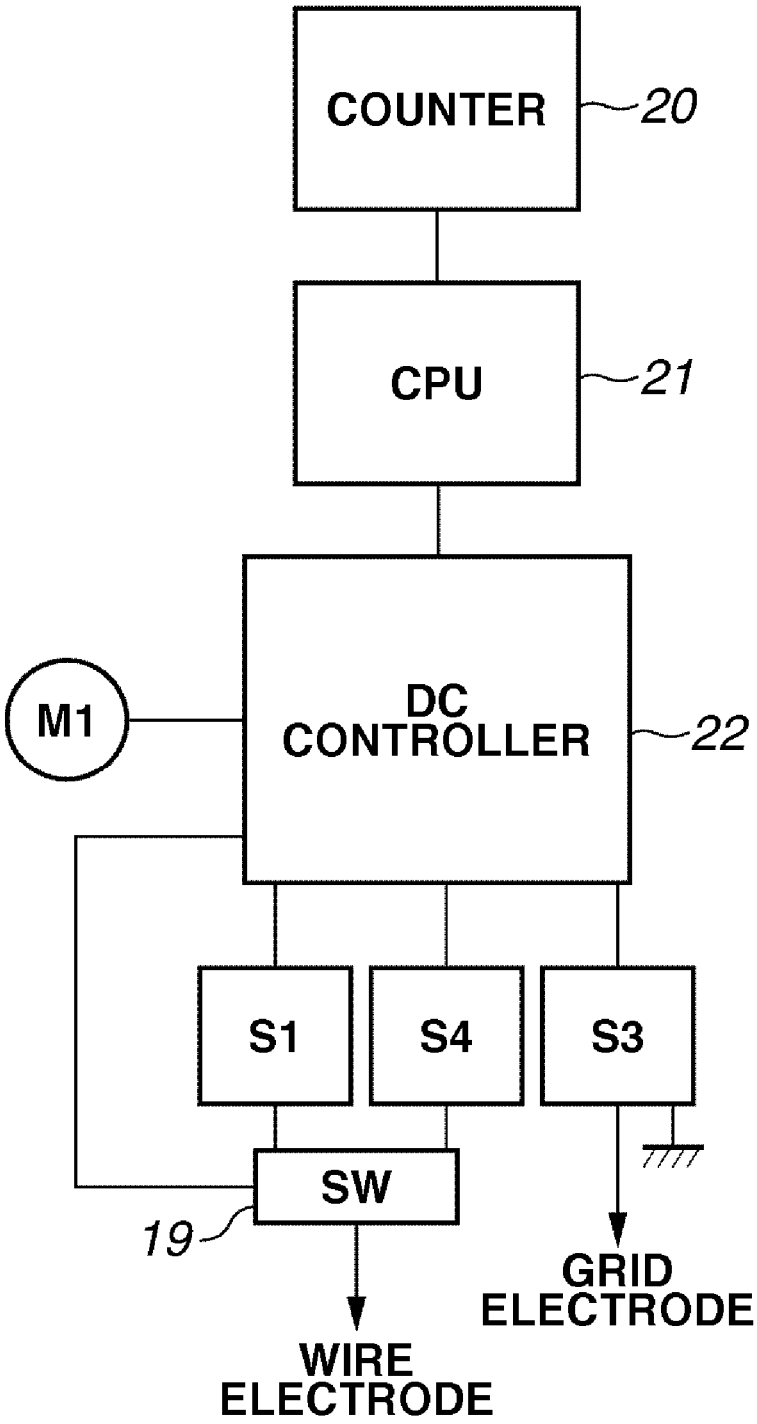
FIG. 9 is a block diagram illustrating a control system for controlling the corona charger.
Figure 10:
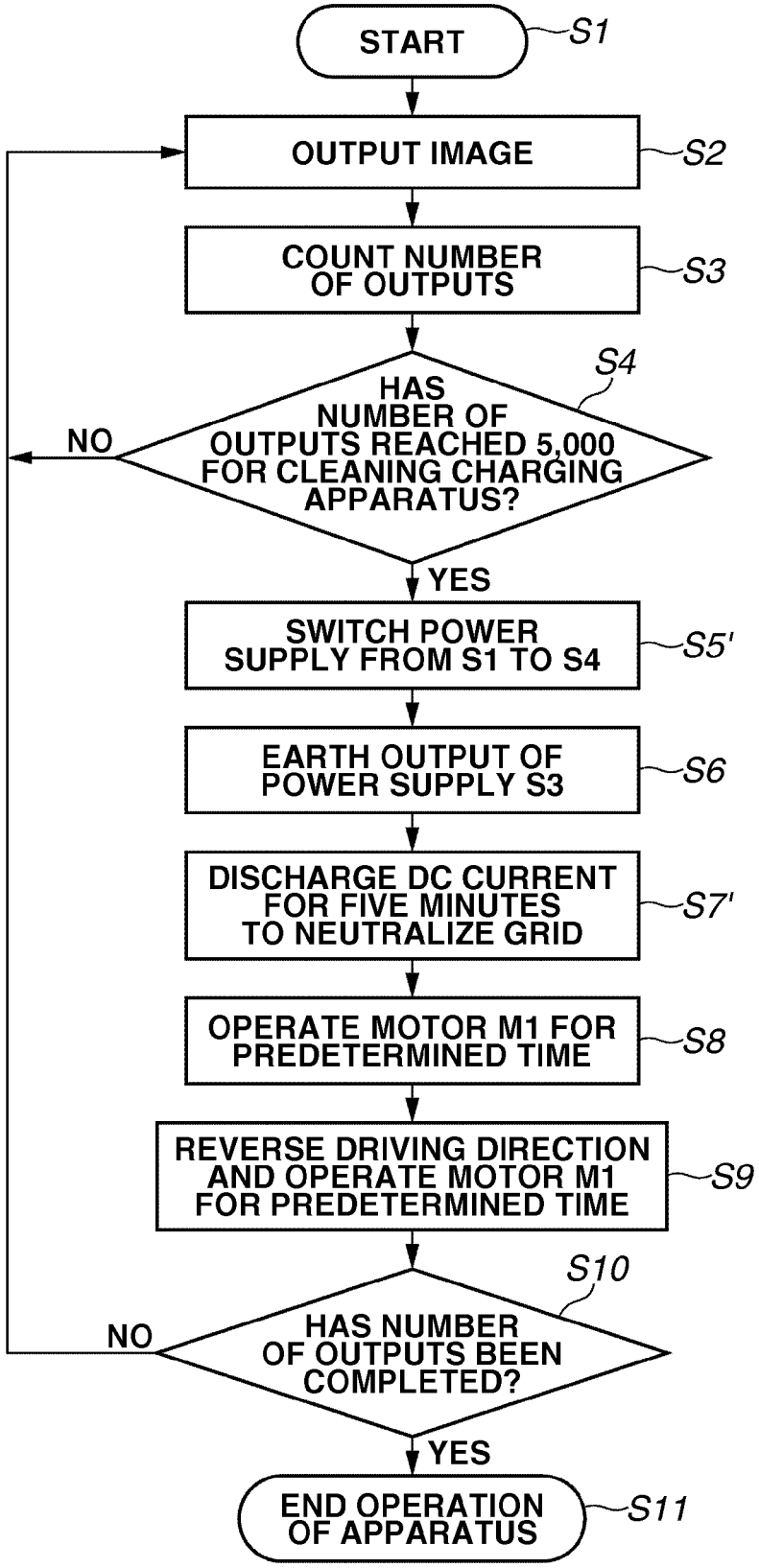
FIG. 10 is a flowchart illustrating a flow of cleaning of the corona charger.

Next, with reference to FIGS. 8, 9, and 10, a second exemplary embodiment will be described. FIG. 8 is a graph illustrating the verification results. FIG. 9 is a block diagram illustrating a control circuit for controlling the cleaning apparatus that cleans the charging apparatus 2. FIG. 10 is a flowchart illustrating a cleaning sequence for the corona charger.

According to the present exemplary embodiment, a method for neutralizing the grid electrode 13 before cleaning the grid electrode 13 is different from that of the first exemplary embodiment. Thus, since the configuration other than the neutralization method is similar to that of the first exemplary embodiment, the same reference numerals are given and the detailed description will not be repeated.

According to the first exemplary embodiment, the AC voltage is used as the neutralizing voltage applied to the discharging wire 12 when the grid electrode is neutralized. On the other hand, according to the present exemplary embodiment, the DC voltage is used.

More specifically, when the grid electrode is neutralized, the DC voltage (positive polarity) having an opposite polarity of the DC voltage (negative polarity) applied for normal charging is applied to the discharging wire 12. The DC voltage is applied to perform the corona discharge, so that the foreign substances adhering to the grid electrode 13 is neutralized.

According to the present exemplary embodiment, as illustrated in FIG. 9, the power supply S1 for forming the normal image and a power supply S4 for the neutralization are provided as the power supplies for applying the voltage to the discharging wire 12. Either one of the power supplies S1 and S4 is connected to the discharging wire 12 via the switch 19. The DC controller 22 controls the operation of the switch 19.

The present exemplary embodiment also employs the configuration in which the neutralization unit neutralizes the grid electrode 13, before cleaning thereof. According to the present exemplary embodiment, the power supply S4, the discharging wire 12, and the switch 19 function as the neutralization unit.

As described above, since the present exemplary embodiment employs the configuration in which the DC voltage is applied for the neutralization, the alternating current power supply is not necessary. Thus, the present exemplary embodiment can reduce apparatus costs and noise and is more advantageous than the first exemplary embodiment.

Next, with reference to FIG. 8, a verification experiment will be described.

In the present exemplary embodiment, similarly to the first exemplary embodiment, after the toner was applied to the grid electrode under the above-described condition, the same voltage as that for forming the normal image was applied to the discharging wire and the gird electrode for sixty seconds. More specifically, the charging voltage was applied to the discharging wire such that the charging current becomes −800 μA, and the voltage of −700 V was applied to the grid electrode. Subsequently, the grid electrode was neutralized and then cleaned, and the cleaning efficiency Y (%) was measured.

For the neutralization, the power supply for applying the voltage to the discharging wire was changed from the power supply S1 to the power supply S4 to apply the neutralizing voltage by the switch 19 illustrated in FIG. 9. At this time, the neutralizing DC voltage is applied to the discharging wire 12 such that the charging current becomes +800 μA (constant current control). Further, at this time, the power supply S3 is turned off, and the grid electrode is grounded.

The time for applying the neutralizing DC voltage to the discharging wire, which is the neutralization time, was set to zero seconds, five seconds, twenty seconds, and forty seconds.

As illustrated in FIG. 8, the cleaning efficiency Y (%) hit a peak when the neutralization time is five seconds and subsequently deteriorated gradually. This is because the toner which is charged during the normal image formation and has the negative polarity is gradually neutralized by receiving the neutralizing corona discharge, and then the amount of the charge becomes smallest when the neutralization time is five seconds. Then, the polarity is reversed and the toner is charged to have the positive polarity.

Therefore, according to the present exemplary embodiment, the time for applying the neutralizing voltage to the discharging wire at the time of neutralization, was set to five seconds.

Next, with reference to a flowchart illustrated in FIG. 10, the cleaning sequence will be described. The flowchart illustrated in FIG. 10 is substantially similar to the flowchart of the first exemplary embodiment illustrated in FIG. 5. More specifically, since only the neutralizing voltage is different in the present exemplary embodiment, only steps S5' and S7' are different. The CPU 21 entirely controls these steps of the cleaning sequence.

Upon starting the image formation in step S1, the image output is started in step S2, and the counter 20 counts the number of the image outputs in step S3. In step S4, when the CPU 21 determines that the number of the image outputs has not reached the predetermined number (5,000) (NO in step S4), steps S1, S2, and S3 are repeated.

When the CPU 21 determines that the number of the image outputs reaches the predetermined number (5,000) (YES in step S4), processing proceeds to step S5'.

In step S5', the CPU 21 instructs the DC controller 22 to send a signal for operating the switch 19. More specifically, the voltage to be applied to the discharging wire 12 is switched from the charging voltage by the power supply S1 to the neutralizing voltage by the power supply S4. At this time, in step S6, the power supply S3 is turned off and the grid electrode is grounded.

In step S7', the DC voltage is applied from the power supply S4 to the discharging wire 12 for five seconds to neutralize the foreign substances such as the toner adhering to the inner surface of the grid electrode 13.

In step S8, the motor M1 for driving the cleaning apparatus is operated to move the discharging wire cleaning device 15 and the grid electrode cleaning device 14 from the home position to the reversal position.

In step S9, when the discharging wire cleaning device 15 and the grid electrode cleaning device 14 reach the reversal position, the rotating direction of the motor M1 is reversed to reverse the moving direction of the discharging wire cleaning device 15 and the grid electrode cleaning device 14. When the discharging wire cleaning device 15 and the grid electrode cleaning device 14 reach the home position, the motor M1 is stopped to end the series of the cleaning processing.

When the cleaning ends, in step S10, the CPU 21 determines if the image forming job has not finished due to interruption by the cleaning. If the image forming job has not finished (NO in step S10), processing returns to step S2 and the suspended image output is resumed. At this time, the signal from the DC controller 22 causes the switch 19 to switch the power supply to apply the voltage to the discharging wire 12 from the power supply S4 to the power supply S1. Further, the power supply S3 for the grid electrode 13 is turned off.

When the remaining image formation of the image formation job is completed, the operation of the image forming unit ends (the power supplies S1 and S3 are turned off).

On the other hand, if the image forming job has finished when the cleaning processing is performed (YES in step S10), then in step S11, the operation of the image forming unit also ends.

As described above, according to the present exemplary embodiment similarly to the first exemplary embodiment, the grid electrode of the corona charger can be appropriately cleaned, so that the charge can be prevented from becoming uneven and occurrence of the non-uniform image density can be prevented. However, according to the second exemplary embodiment, the adhering substances such as the toner and the paper powder adhering to the inner surface of the grid electrode may be charged with opposite polarity. Thus, neutralizing the AC voltage according to the first exemplary embodiment can be advantageous at this point.

The first and second exemplary embodiments describe the example in which the charging apparatus (corona charger) is used for evenly charging the photosensitive member. However, the configuration of the exemplary embodiments is not limited to the above-described example, and the following configuration can be employed.

For example, the charging apparatus (corona charger) similar to that in the first and second exemplary embodiments can be used for charging a toner image formed on the photosensitive member before the toner image is transferred onto a sheet.

Further, instead of a transfer roller used in the transfer apparatus 4, the charging apparatus (corona charger) similar to that in the first and second exemplary embodiments may be employed. In other words, the charging apparatus is used in a transfer process according to this example.

The first and second exemplary embodiments describe the examples of the photosensitive member used as the member to be charged. However, the member to be charged is not limited to the above-described example, and the following member to be charged can be employed.

For example, the member to be charged may be a known intermediate transfer member. The intermediate transfer member is used to primary-transfer the toner image formed on the photosensitive member thereto and to secondary-transfer the toner image to the sheet. In this case, the charging apparatus (corona charger) can be used to charge the toner image which is primary-transferred from the photosensitive member to the intermediate transfer member before the secondary transfer.

The charging apparatus (corona charger) can be used in the primary transfer process from the photosensitive member to the intermediate transfer member and the secondary transfer process from the intermediate transfer member to the sheet.

The first and second exemplary embodiments describe an example of the configuration in which the discharging wire is used as the neutralization unit to which the neutralizing voltage is applied in order to neutralize the grid electrode. However, the configuration is not limited to the above-described example, and the following configuration can be used.

For example, a specific discharging device for neutralizing the grid electrode may be separately provided and perform neutralizing of the grid electrode. However, such a configuration can be complicated. Accordingly, as the first and second exemplary embodiments described above, using the discharging wire is more desirable.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-236314 filed Sep. 16, 2008, which is hereby incorporated by reference herein in its entirety.

What is claimed is:

1. A charging apparatus comprising:

a corona charger which includes a discharging wire and a grid electrode that are configured to charge a member to be charged;

a cleaning device configured to clean an inner surface of the grid electrode;

a first direct current (DC) power supply configured to apply a DC voltage to the discharging wire to charge the member to be charged;

a second DC power supply configured to apply a DC voltage to the grid electrode to charge the member to be charged; and a discharging device configured to electrically discharge the grid electrode before the cleaning device cleans the grid electrode, wherein the discharging device includes an AC power supply configured to apply an AC voltage to the discharging wire, a switch configured to switch from the first DC power supply to the AC power supply, and an earth structure configured to electrically ground the grid electrode.

2. The charging apparatus according to claim 1, wherein the cleaning device comprises a brush which is slidable on the grid electrode.

3. The charging apparatus according to claim 1, wherein the charging apparatus charges an electrophotographic photosensitive member which is the member to be charged.

* * * * *